United States Patent [19]

Nopper

[11] 4,273,981

[45] Jun. 16, 1981

[54] APPARATUS FOR HEATING A FLEECE

[75] Inventor: Herbert Nopper, Kuppenheim, Fed. Rep. of Germany

[73] Assignee: Casimir Kast GmbH & Co. K.G., Gernsbach, Fed. Rep. of Germany

[21] Appl. No.: 85,762

[22] Filed: Oct. 17, 1979

[51] Int. Cl.[3] ..... H05B 5/08

[52] U.S. Cl. ..... 219/10.49 R; 53/557; 34/216; 264/120; 219/10.51; 219/10.71; 219/381; 219/388; 219/400; 425/83.1; 432/122

[58] Field of Search ..... 219/10.49 R, 10.51, 219/10.69, 388, 10.71, 381, 400, 541, 553, 216; 53/557; 338/254, 255; 156/80, 311, 498; 264/120, 121, 122; 425/83.1; 432/122; 228/43; 34/216

[56] References Cited

U.S. PATENT DOCUMENTS

| | | | |
|---|---|---|---|
| 2,113,770 | 4/1938 | Richardson | 219/388 X |
| 2,356,826 | 8/1944 | Cross et al. | 264/120 |
| 2,492,908 | 12/1949 | Von Hope | 219/388 X |
| 3,517,164 | 6/1970 | Huggins et al. | 219/388 |
| 3,756,489 | 9/1973 | Charlet | 228/43 |
| 3,932,258 | 1/1976 | Brinkman et al. | 156/498 |
| 3,956,614 | 5/1976 | Hervert | 219/541 |
| 3,980,863 | 9/1976 | Wulz et al. | 219/388 |
| 3,995,143 | 11/1976 | Hervert | 219/553 |
| 4,032,752 | 6/1977 | Ohmura et al. | 219/541 |
| 4,162,604 | 7/1979 | Bartolomei | 53/557 |

FOREIGN PATENT DOCUMENTS

| | | | |
|---|---|---|---|
| 268635 | 2/1969 | Austria | 219/338 |

*Primary Examiner*—Volodymyr Y. Mayewsky
*Attorney, Agent, or Firm*—Craig & Antonelli

[57] ABSTRACT

A method of heating a fleece comprises supporting the fleece on a perforate fleece carrier and passing a heated gas through the fleece and fleece carrier, preferably in that sequence to assist compaction of the fleece. Apparatus for performing this method comprises two chambers between which the fleece is passed on the carrier, the chambers being maintained at different pressures by a fan to create the flow through the fleece and through a radiator for heating the gas. The gas may be recirculated and may be filtered and/or augmented by a further supply. A roller at the exit end of the chambers compresses the heated fleece, preferably from above. The fleece carrier may be preheated upstream of the heating station, for example by induction heating in the case of a metal fleece carrier. A freely running roller having adjustable height rests on the fleece and seals the entry to the heating station.

14 Claims, 4 Drawing Figures

12
10
8
4
11
23
18
19
20
9
22
21
3
16
1
2
15
5
6
17

10
8
11
4
23
9
1
2
13
8
5
14
7
6

APPARATUS FOR HEATING A FLEECE

The invention relates to a method for heating a fleece as well as to a device for the performance of such a method.

In the production of particle boards, fibreboards, board-or mat-shaped material which can be pressed into moulded parts and consists of material containing chemical wood pulp and of binding agents, etc., the procedure is as a rule such that following an appropriate preparation, the raw material (particles, cellulose fibrous mass, etc.) is mixed with binding agents and other additives and is spread on a mobile fleece carrier, which takes for example the form of a revolving belt, so as to form a fleece. Such a fleece is a combination of a more or less fine-particled material, which combination is felted to a greater or lesser degree but is altogether loose, and by the application of pressure, if necessary in conjunction with the action of heat, is compressed into the finished product (e.g. fibreboard, particle board) or a transportable intermediate product (e.g. pressable cellulose fibre material in the form of mats), the particles of the fleece being bonded by the binding agents, as a rule thermoplastic and/or thermosetting synthetic resins.

The material from which the fleece is spread is usually dried to such an extent that it can be spread sufficiently evenly and without forming conglomerations. However, another drying process by way of heat action is usually required so as to prevent during finish-pressing any disturbances caused by the formation of steam due to the existing residual moisture. Furthermore, the compression of the fleece is as a rule effected through the application of heat, as already mentioned, so as to allow the binding agents to come into action. Thus a heating of the fleece is necessary.

It is known (from practice) to heat the fleece material by means of hot air in special chambers prior to the fleece formation during the transportation of the material. A relatively long time interval between the heating and the compression of the fleece cannot be avoided, so that prior to compression considerable cooling occurs and the binding agents react prematurely. Furthermore known is the heating of the fleece in a continuous flow directly prior to compression through the action of high-frequency energy. However, this working method is expensive and, above all, does not lead to a sufficiently even heating over the entire cross section. The same applies to heating effected in radiation chambers, through which the fleece is continuously passed prior to compression.

The task underlying the invention is to indicate how a homogeneous and exactly checkable heating of a fleece can be brought about in a simple and trouble-free manner, particularly in a continuous passage thereof.

According to the invention, this task is solved, as regards the method, in that a heated gas flows through the fleece which is received on a perforated fleece carrier.

The flow through the fleece can be brought about in a simple manner by the application of a positive pressure on one side of the fleece and/or of a negative pressure on the other side thereof. As the heated gas, that is to say as the heat-transfer medium, air will usually be used but, depending on the application, the operation may be effected to advantage with an inert gas, such as nitrogen, carbon dioxide, etc. If chemically reacting binding agents are involved, it is furthermore possible, depending on the chemism thereof, to standardise a special reaction atmosphere through an appropriate composition of the gas. A wide variety of possibilities is given for the construction of the perforated fleece carrier, the only requirement being that the flow of the gas therethrough is ensured. For example, the fleece carrier may be designed as a woven, knitted or non-woven fabric of appropriate permeability or as a screen made of wire netting or perforated plate. In any event, a uniform, intensive and exactly checkable heating of the fleece can be brought about by the gas flowing therethrough. Surprisingly, it has been shown that a whirling-up of the fleece material by the gas flow can be readily avoided: The fleece is indeed loose but as a rule already more or less felted. If, in addition, as provided for by the invention, the flow therethrough is effected in the direction of the fleece carrier, then this brings about a further compression and felting which does not allow any appreciable whirling-up to occur. In this connection, it is recommended to guide the gas flow as a laminar flow that is orthogonal to the extension of the fleece.

Heating of the gas is preferably effected in that this latter passes through a radiator prior to entering the fleece. By a radiator there is understood in this connection an arrangement of heating elements in the shape of a grating, between which there are left clear flow channels and which are preferably ribbed for enlarging the surface and which are heated electrically or by a heating medium flowing therethrough. If adapted accordingly, such a radiator simultaneously acts as a flow rectifier and thus improves the uniformity and steadiness of the flow. The heated gas is preferably sucked off when it emerges from the fleece and is returned in a circuit, if necessary following filtration. In this connection, it is recommended to branch off an adjustable proportion of the returned gas, to feed it to a separator in which any moisture that has been absorbed, vapours, etc. are separated, and to return it to the circuit, if desired. Prior to its entry into the radiator, an adjustable proportion of fresh air may be added to the gas. This may be effected, in particular, within the framework of a temperature regulation, for which purpose the temperature of the heated gas is taken by a thermometer prior to its entry into the fleece. It is furthermore advantageous if, in addition, the fleece carrier is heated directly prior to the heating of the fleece.

A device according to the invention for the performance of the described method is characterised by a high-pressure chamber and/or a low-pressure chamber, which are opposite to each other with respect to the fleece, and by a perforated fleece carrier and by a fan, which is connected to the high-pressure chamber and/or the low-pressure chamber, and by a radiator comprising heating elements which leave clear between them flow channels for a gas flowing through the fleece. In this connection, high pressure and low pressure only designate the relative pressure ratios on the two sides of the fleece so that, as already indicated, one of the two pressure chambers may of course be subjected to atmospheric pressure. It is recommended to connect the fan to the high-pressure chamber by a pressure line and to the low-pressure chamber by a suction line so as to form a closed circuit.

Advantageously, the high-pressure chamber is provided above the fleece, so that the fleece is pressed against the fleece carrier by the gas flow, thus being additionally compressed and felted. In order to bring about an intensive heating of the fleece with the smallest possible vorticity, it is recommended to provide a flow rectifier, which is provided with flow channels that are orthogonal to the fleece, at the high-pressure side of the fleece and directly adjacent to the fleece.

There are various possibilities for the arrangement of the radiator which, as explained, is constructed as a heat exchanger according to known 'per se' aspects which is heated by electric resistance heating, a heating medium flowing through appropriate channels, etc. Direct heating on the pressure side is given if the radiator is provided at the high-pressure side of the fleece. In this connection, there exists the particularly advantageous possibility of providing the radiator directly adjacent to the fleece and to design it with flow channels extending orthogonally to the fleece, so that an additional flow rectifier is not required. With a view to heat utilisation and control or regulation, heating on the suction side can bring advantages. For example, the possibility of direct heating on the suction side exists in that the radiator is interposed in the suction line leading from the low-pressure chamber to the fan. For indirect heating on the suction side, the radiator is interposed in a tap line which is connected to the suction line, which passes from the low-pressure chamber to the fan, and opens out into the free atmosphere. The proportions of the gas recirculated from the low-pressure chamber and the fresh gas heated in the radiator can be set by appropriate butterfly valves. In the same way, it is of course possible for direct heating (on the suction or pressure side) to vary the pressure and flow ratios by means of appropriate valves in the suction and/or pressure line. In addition, it may be recommendable to provide on the high-pressure side of the fleece, i.e. directly forward of the fleece or possibly forward of the flow rectifier a distributor means which has an adjustable cross section of passage and which extends of course over the entire cross section of the high-pressure chamber. Such a distributor means may consist, for example, of a pair of perforated plates which can be displaced relative to each other.

By adapting the radiator, with respect to its flow resistance, to the fleece, it is possible to optimise the heat transfer in relation to the pressure losses in the radiator. Conditions which are particularly favourable in this respect are obtained if the radiator flow resistance, that has been related to the high-pressure side of the fleece (with respect to the cross sections and the flow rates), substantially corresponds to the flow resistance of the fleece. For the rest, it is recommended to provide at a suitable point, preferably at the inflow side of the radiator, a filter for the removal of foreign particles from the gas.

In consideration of the thermal characteristics of the fleece carrier, which differ from the fleece, it may be recommendable to arranged upstream of the high-pressure or low-pressure chamber (where heating of the fleece is effected) a pre-heating station for heating the fleece carrier. If the fleece carrier consists of a high-temperature resistant plastics material screen (e.g., polyamide), then it can be guided over a heated surface and be heated by contact heat. However, it is particularly advantageous to manufacture the fleece carrier from a flexible perforated metal foil or from a woven or knitted fabric in metallic wire and to heat it inductively by the generation of eddy currents, which can be readily effected at the mains frequency.

A special advantage of the afore-described method of operation consists in that the attainable uniform and intensive heating of the fleece makes it possible to work in a continuous flow. To this end, there is provided between the high-pressure and low-pressure chambers a guide track for a revolving fleece carrier. The fleece carrier may of course be integrated in the framework of a more comprehensive installation and may, for example, be taken from a moulding head for the fleece formation past the described heating unit to a press and an adjoining separating station as well as from this latter back to the moulding head. In the event of there being provided a subsequently arranged pressing means for compression of the heated fleece, a particularly advantageous constructional form consists in that the pressing means comprises at least one pressure roller acting on the upper side of the heated fleece and in that the pressure roller projects, with a portion of its circumference, into the high-pressure or low-pressure chamber and is sealed with respect to the wall of the high-pressure or low-pressure chamber. A pressure roller is usually only provided on the upper side of the fleece, while the fleece carrier runs over a stationary abutment; however, it is of course possible to provide pressure rollers above and below the fleece. In any event, the described development ensures in a particularly simple manner the sealing of the pressure chambers at the outlet end of the fleece. At the inlet end, i.e. at the high-pressure or low-pressure end that is to the front in the supply direction of the fleece, sealing can be brought about in that there is provided a free-running roller which extends over the width of the fleece and rests on the fleece and can be freely adjusted in height while being sealed with respect to the wall of the high-pressure or low-pressure chamber. The free vertical adjustability allows the roller to be adapted all the time to the respective fleece thickness and may be brought about, for example, in that the roller is guided in guide slots which are inclined towards the flow direction of the fleece and are preferably parallel to the front wall of the high-pressure or low-pressure chamber.

For checking the temperature of the heated gas, there may be provided a temperature measuring device which is preferably arranged directly where the gas enters the fleece. Advantageously, the temperature measurement is used within the framework of a regulating circuit for regulating the temperature of the gas. The regulation may be effected, for example, by the controlled addition of fresh air or (in the case of indirect heating from the suction side) by the appropriate setting of the proportions of fresh and recirculated air.

For safety reasons, it is recommended to provide an extinguishing means in the fleece area, preferably in the high-pressure chamber.

Hereinafter, the invention will be explained in more detail with reference to the drawings illustrating only one exemplified embodiment. In the drawings.

Figure 1:
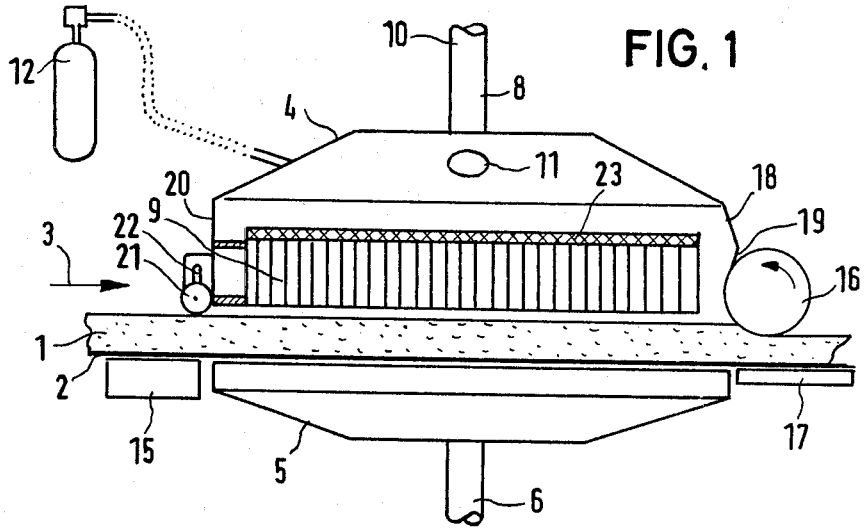
FIG. 1 shows a unit for heating a fleece, in a side view shown in a diagrammatical representation.

The unit shown in the Figures serves for heating a fleece 1 which consists of a mixture of cellulose fibre material, thermoplastic and thermosetting binding agents and additives and is produced within the framework of the manufacture of pressable mat-like cellulose fibre material and is compressed through the action of heat. Heating of the fleece 1 is effected in a continuous flow, for which purpose the fleece 1 has been placed on a revolving fleece carrier 2 and is passed through the device in the direction of the arrow 3.

In its basic construction, the illustrated device consists of a high-pressure chamber 4 arranged above the fleece 1 and a low-pressure chamber 5 arranged beneath the fleece 3. A gas, which is air in the exemplified embodiment, flows from the high-pressure chamber 4 through the fleece 1 and the fleece carrier 2, which is perforated for this purpose, being designed as a revolving screen, into the low-pressure chamber 5 and from there through a suction line 6, a fan 7 and a pressure line 8 back into the high-pressure chamber 4.

In the high-pressure chamber 4, directly above the fleece 1, there is arranged a radiator 9 which substantially consists of electrically heated heating elements (not shown in detail) which, for enlarging the surface, are ribbed and which leave clear between themselves flow channels which extend orthgonally to the extension of the fleece 1. The air to be heated flows from the high-pressure chamber 4 initially through the radiator 9, is heated therein to a temperature of up to 200° C. in the exemplified embodiment and subsequently enters the fleece 1, where it releases the heat absorbed in the radiator 9.

A proportion of the air returned from the low-pressure chamber 5, which proportion can be adjusted by a valve 10, is fed to a separator (not shown), is freed from any moisture absorbed from the fleece 1 and impurities as well as vapours or the like, and may also be fed back. In addition, there is provided a fresh air line 11, through which an adjustable proportion of fresh air may be added. Beneath the radiator 9, there are arranged temperature mesuring devices (not shown in the drawing) which are used, within the framework of a regulating circuit which acts on the fresh air supply and on the energy supply to the radiator 9, for regulating the temperature of the air entering the fleece 1. For safety reasons, a $CO_2$ extinguisher 12 is finally connected to the radiator 9.

Figure 2:
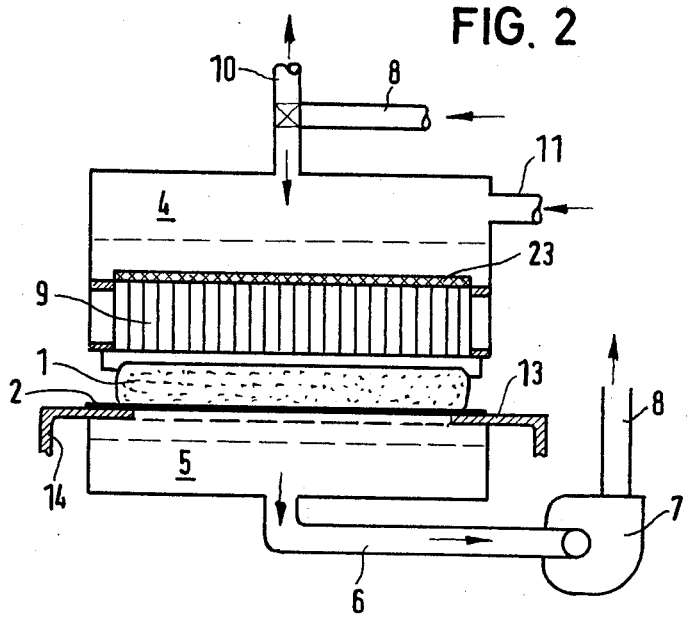
FIG. 2 shows the subject of FIG. 1 in a cross section.

The cross section through the described device shown diagrammatically in FIG. 2 additionally reveals between the high-pressure chamber 4 and the low-pressure chamber 5 a guide track 13, on which the fleece carrier 2 is guided and which is of course also perforated so as to allow the passage of the heated air. The guide track 13 is ragidly connected to a machine frame 14, on which the pressure chambers 4, 5 are also arranged.

Upstream of the described heating station, which is substantially formed by the high-pressure and low-pressure chambers, there is arranged a pre-heating station 15, details of which are not shown and in which the fleece carrier, consisting of metal wire netting, is heated by eddy current induction.

The fleece 1 is heated in a continuous flow in the described device and passes directly subsequently thereto into a pressing unit, in which it is compressed in the heated state so as to form a transportable pressable mat. In the exemplified embodiment shown, the pressing unit substantially consists of a pressure roller 16 which acts on the upper side of the fleece 1 and operates against a stationary abutment 17, over which the fleece carrier 2 is guided. As FIG. 1 reveals, the pressure roller 16 projects with a portion of its circumference into the high-pressure chamber 4 and is sealed relative to the wall thereof which is to the rear in the flow direction 3 of the fleece 1 by a sealing lip 19. The pressure roller 16 can be adjusted with respect to the abutment 17 for the adjustment of the thickness or the degree of compression of the emerging mat, the sealing provided by the sealing lip 19 being maintained.

On the wall 20 of the high-pressure chamber 4, which wall is to the front in the flow direction 3, there is provided a freely running roller 21 which extends over the width of the fleece 1 and rests thereon in a freely rotatable manner. The roller 21 is rotatably guided in guide slots 22, which are transverse of the flow direction of the fleece 1, and is adjustable in height in adaptation to the respective thickness of the fleece 1 while being sealed with respect to the front wall 20 of the high-pressure chamber 4.

The Figures show various possibilities for the arrangement of the radiator 9.

Figure 3:
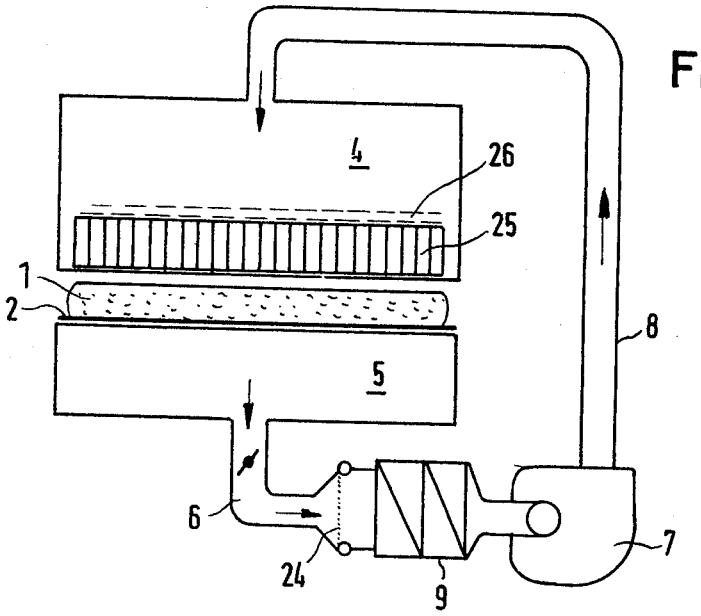
FIG. 3 shows a different constructional form of the subject of FIG. 2 in a simplified representation.
Figure 4:
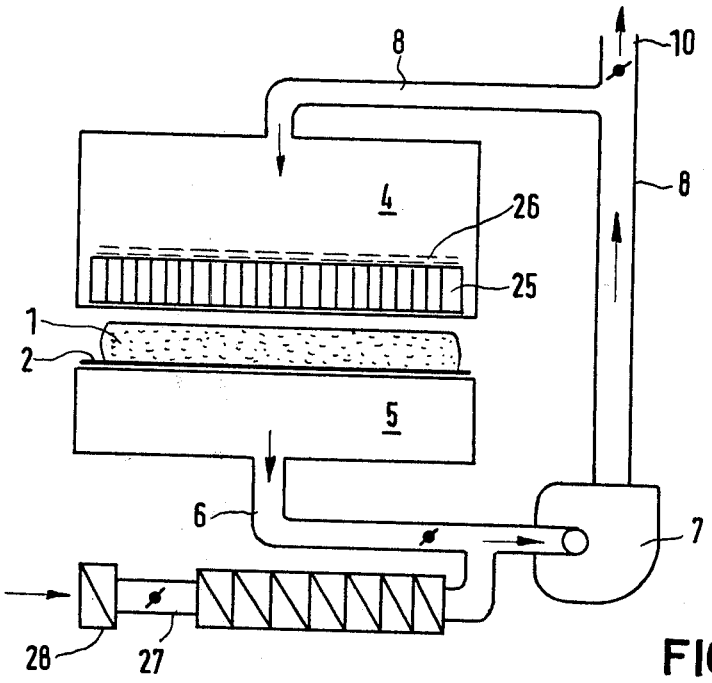
FIG. 4 shows another constructional form of the subject of FIG. 2 in a simplified representation.

In the constructional form shown in FIG. 2, direct heating is effected at the pressure side. Herein, the radiator 9 is arranged in the high-pressure chamber 4, namely directly above the fleece 1, where it simultaneously acts as a flow rectifier. Above the radiator 9, there is arranged a filter 23 of corresponding areal extension. FIG. 3 shows, in a considerably simplified representation, direct heating at the suction side, the radiator 9 being inserted in the suction line 6 between the low-pressure chamber 5 and the fan 7. Upstream of the radiator 9, there is arranged a roll tape filter 24. A special flow rectifier 25 is arranged in the high-pressure chamber 4 directly above the fleece 1. At the inflow side of the flow rectifier 25, there is located a distributor unit 26 which has an appropriate surface extension and substantially consists of two plates which are perforated in the same manner and can be adjusted relative to each other end, depending on the overlapping of the perforations, uncover varying cross sections of passage. In FIG. 4, there is shown indirect heating at the suction side, where the radiator 9 is inserted in a tap line 27 which is connected to the suction line 6 and opens out into the free atmosphere through a filter 28. Here, too, a flow rectifier 25, including a distributor unit 26 provided thereabove, is disposed directly above the fleece 1. In all the exemplified embodiments shown, the pressure and flow ratios as well as the proportions of recirculated air and freshly added air are adjusted by appropriate butterfly valves, which need not be discussed in detail in this connection.

I claim:

1. A device for heating a fleece, comprising a heating station having two chambers arranged so as to be opposite to each other with respect to a fleece passing therebetween, a moving perforated fleece carrier on which said fleece is disposed, a fan connected to said chambers to maintain one of said chambers at a higher pressure than the other of said chambers, said fan being connected to the high pressure one of said chambers by a pressure conduit and to the low pressure one of said chambers by a suction conduit so as to form a closed circuit, and a heating radiator having heating elements therein learning clear between themselves flow channels for a gas heating and flowing through the fleece.

2. A device as claimed in claim 1, comprising a flow rectifier having flow channels therethrough which are orthogonal to the fleece and said rectifier is arranged on the high pressure side of and directly adjacent the fleece.

3. A device as claimed in claim 1, in which the radiator is disposed in the high pressure one of said chambers.

4. A device as claimed in claim 3, in which the radiator is located directly adjacent the fleece and provides a flow rectifier having flow channels therethrough which extend orthogonally to the fleece.

5. A device as claimed in claim 1, in which the radiator is interposed in the suction conduit leading from the low pressure one of said chambers to the fan.

6. A device as claimed in claim 1, in which the radiator is interposed in a tap conduit which has one end thereof connected to the suction conduit and which at the other end thereof is open to the free atmosphere.

7. A device as claimed in claim 1, in which a distributor unit, having an adjustable cross-section of gas passage therethrough, is provided in the high pressure one of said chambers.

8. A device as claimed in claim 3, in which the radiator flow resistance corresponds substantially to the flow resistance of the fleece.

9. A device as claimed in claim 1, comprising a preheating station for heating the fleece carrier located upstream of the heating station.

10. A device as claimed in claim 9, in which the fleece carrier consists of electrically conductive material and the pre-heating station comprises heating means providing inductive heating of the fleece carrier.

11. A device as claimed in claim 1, further comprising a guide track adapted to guide said fleece carrier between the high pressure and low pressure chambers.

12. A device as claimed in claim 1, further comprising a pressing means downstream of said heating station for the compression of the heated fleece, the pressing means having at least one pressure roller positioned to act on the upper side of the heated fleece, to project with a portion of its circumference, into at least one of said chambers and sealed with respect to a wall of said at least one chamber.

13. A device as claimed in claim 1, in which at least one of said chambers has an upstream end with regard to the flow direction of the fleece, at which upstream end there is located a freely running roller positioned to rest on the fleece and which extends over the width of the fleece, said roller being freely adjustable in height and being sealed with respect to said upstream end.

14. A device as claimed in claim 1, further comprising a fire extinguishing unit which is connected to the heating station, preferably to the high pressure one of said chambers.

* * * * *

UNITED STATES PATENT AND TRADEMARK OFFICE

CERTIFICATE OF CORRECTION

PATENT NO. : 4,273,981

DATED : June 16, 1981

INVENTOR(S) : Herbert Nopper

It is certified that error appears in the above-identified patent and that said Letters Patent are hereby corrected as shown below: On the title page Between lines [22] and [51], please insert the following:

--[30] Foreign Application Priority Data

Oct. 17, 1978 [DE] Fed. Rep. of Germany .....2845080 --.

Signed and Sealed this

*Third* Day of *August 1982*

[SEAL]

*Attest:*

GERALD J. MOSSINGHOFF

*Attesting Officer* *Commissioner of Patents and Trademarks*